US009590304B2

(12) United States Patent
You et al.

(10) Patent No.: US 9,590,304 B2
(45) Date of Patent: Mar. 7, 2017

(54) BROADBAND ANTENNA

(71) Applicant: Wistron NeWeb Corporation, Hsinchu (TW)

(72) Inventors: Shang-Sian You, Hsinchu (TW); Chien-Ting Huang, Hsinchu (TW); Chih-Ming Wang, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 45 days.

(21) Appl. No.: 14/603,310

(22) Filed: Jan. 22, 2015

(65) Prior Publication Data

US 2015/0236422 A1 Aug. 20, 2015

(30) Foreign Application Priority Data

Feb. 20, 2014 (TW) ..... 103105733 A

(51) Int. Cl.

| | |
|---|---|
| ***H01Q 1/38*** | (2006.01) |
| ***H01Q 7/00*** | (2006.01) |
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 7/00* (2013.01); *H01Q 1/243* (2013.01); *H01Q 5/371* (2015.01); *H01Q 5/378* (2015.01); *H01Q 9/42* (2013.01)

(58) Field of Classification Search

CPC ..... H01Q 9/0407; H01Q 21/00; H01Q 7/00; H01Q 9/42; H01Q 5/371; H01Q 5/378

See application file for complete search history.

(56) References Cited

U.S. PATENT DOCUMENTS 7,339,531 B2 * 3/2008 Desclos ..... H01Q 1/38 343/700 MS
7,728,783 B2 * 6/2010 Su ..... H01Q 1/242 343/829

(Continued)

FOREIGN PATENT DOCUMENTS

CN 102142596 A 8/2011
TW 201008025 2/2010

(Continued)

*Primary Examiner* — Trinh Dinh
(74) *Attorney, Agent, or Firm* — Winston Hsu; Scott Margo

(57) ABSTRACT

A broadband antenna includes a substrate; a grounding unit; a first radiating element, including a first segment and a second segment substantially perpendicular to each other, wherein the first segment is electrically connected to the grounding unit and the second segment extends toward a direction; a second radiating element, coupled to the first radiating element; a third radiating element having a terminal coupled to or electrically connected to the second radiating element and another terminal electrically connected to the grounding unit; and a signal feed-in element electrically connected to the third radiating element for transmitting or receiving a radio signal; where the first, the second and the third radiating elements are disposed on the substrate along the direction defined by an order of the first segment of the first radiating element, the second radiating element and the third radiating element.

10 Claims, 11 Drawing Sheets

(56) References Cited

U.S. PATENT DOCUMENTS

| | | | | |
|---|---|---|---|---|
| 8,525,732 | B2 | 9/2013 | Utagawa | |
| 8,872,712 | B2 * | 10/2014 | Lee | H01Q 1/243 343/729 |
| 8,890,754 | B2 * | 11/2014 | Lin | H01Q 5/335 343/700 MS |
| 2010/0039329 | A1 * | 2/2010 | Chen | H01Q 1/38 343/700 MS |
| 2010/0103069 | A1 * | 4/2010 | Wang | H01Q 1/243 343/846 |
| 2012/0019415 | A1 * | 1/2012 | Tseng | H01Q 1/243 343/700 MS |
| 2012/0249393 | A1 * | 10/2012 | Hotta | H01Q 1/243 343/843 |
| 2013/0207861 | A1 * | 8/2013 | Huang | H01Q 13/10 343/767 |
| 2013/0271326 | A1 * | 10/2013 | Shimasaki | H01Q 9/045 343/700 MS |

FOREIGN PATENT DOCUMENTS

| | | |
|---|---|---|
| TW | 201017978 | 5/2010 |
| TW | M472323 | 2/2014 |

* cited by examiner

BROADBAND ANTENNA

BACKGROUND OF THE INVENTION

1. Field of the Invention

The present invention relates to a broadband antenna, and more particularly, to a miniature broadband antenna having high radiation efficiency and conforming to regulations of specific absorption rate.

2. Description of the Prior Art

As electronic products with wireless communication functionalities (e.g. tablet PCs, laptops, and mobile phones) become necessary tools in modern life, the number of wireless network applications is increasing, and the demand for higher transmission speed is getting stronger. Broadband antennas are therefore in great demand, especially to comply with advanced communication protocols such as the Long Term Evolution (LTE) technology. Generally, one needs to design a larger antenna in order to obtain broader bandwidth. However, the antenna dimensions need to be minimized to meet the goal of producing thinner and lighter products.

The specific absorption rate (SAR) is one of the essential considerations for antenna designs. In order to conform to regulations of SAR, one should avoid designing a 3D antenna for mobile devices. However, designing a planar antenna does not guarantee that the antenna can pass the SAR criteria. Therefore, it is quite challenging to design an antenna having good radiation efficiency, broad operating bandwidth, small size, and also conforming to the regulations of SAR.

Common types of broadband planar antenna suitable for operating in LTE frequency bands are the planar inverted-F antennas (PIFA) and monopole/parasitic-part combined coupling antennas. The planar inverted-F antennas have conductive pins which may help to improve impedance matching. However, they require larger space to achieve broader bandwidth and better radiation efficiency. The coupling antennas usually have smaller dimensions. However, their performance may be easily affected by environment, and they are hard to be designed with matched impedance.

On the other hand, loop antennas are relatively easy to conform to the regulations of SAR; however, the antenna dimensions are larger since the lengths of their radiating elements should be as long as half wavelength of the resonant frequency. Moreover, their input impedance is too high to be adjusted easily, which therefore narrows the operational frequency bandwidth. As a result, conventional loop antennas are unable to cover all of the frequency bands for LTE applications. Loop antennas are usually used for applications operating in very high frequency bands (e.g. millimeter-wave frequencies), but not for applications operating in LTE frequency bands.

Therefore, it has become a common goal in the industry to design an antenna with reduced antenna dimensions and improved antenna bandwidth while the antenna maintains good radiation efficiency and conforms to the regulations of SAR.

SUMMARY OF THE INVENTION

An objective of the present invention is to provide a miniature broadband antenna that solves the abovementioned problems. The miniature broadband antenna is a monopole antenna unit combining a grounded type coupling antenna unit and a loop antenna unit, which has wide operational bandwidth and good radiation efficiency and conforms to the regulations of SAR for all of its operational frequency bands.

An embodiment of the present invention discloses a broadband antenna used in a wireless communication device. The broadband antenna includes a substrate; a grounding unit, for providing ground; a first radiating element, comprising a first segment and a second segment, substantially perpendicular to each other, wherein the first segment is electrically connected to the grounding unit and the second segment extends toward a direction; a second radiating element, coupled to the first radiating element; a third radiating element, having a terminal coupled to or electrically connected to the second radiating element and another terminal electrically connected to the grounding unit; and a signal feed-in element, electrically connected with the third radiating element for transmitting or receiving a radio signal; where the first, the second, and the third radiating elements are disposed on the substrate along the direction defined by an order of the first segment of the first radiating element, the second radiating element and the third radiating element.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
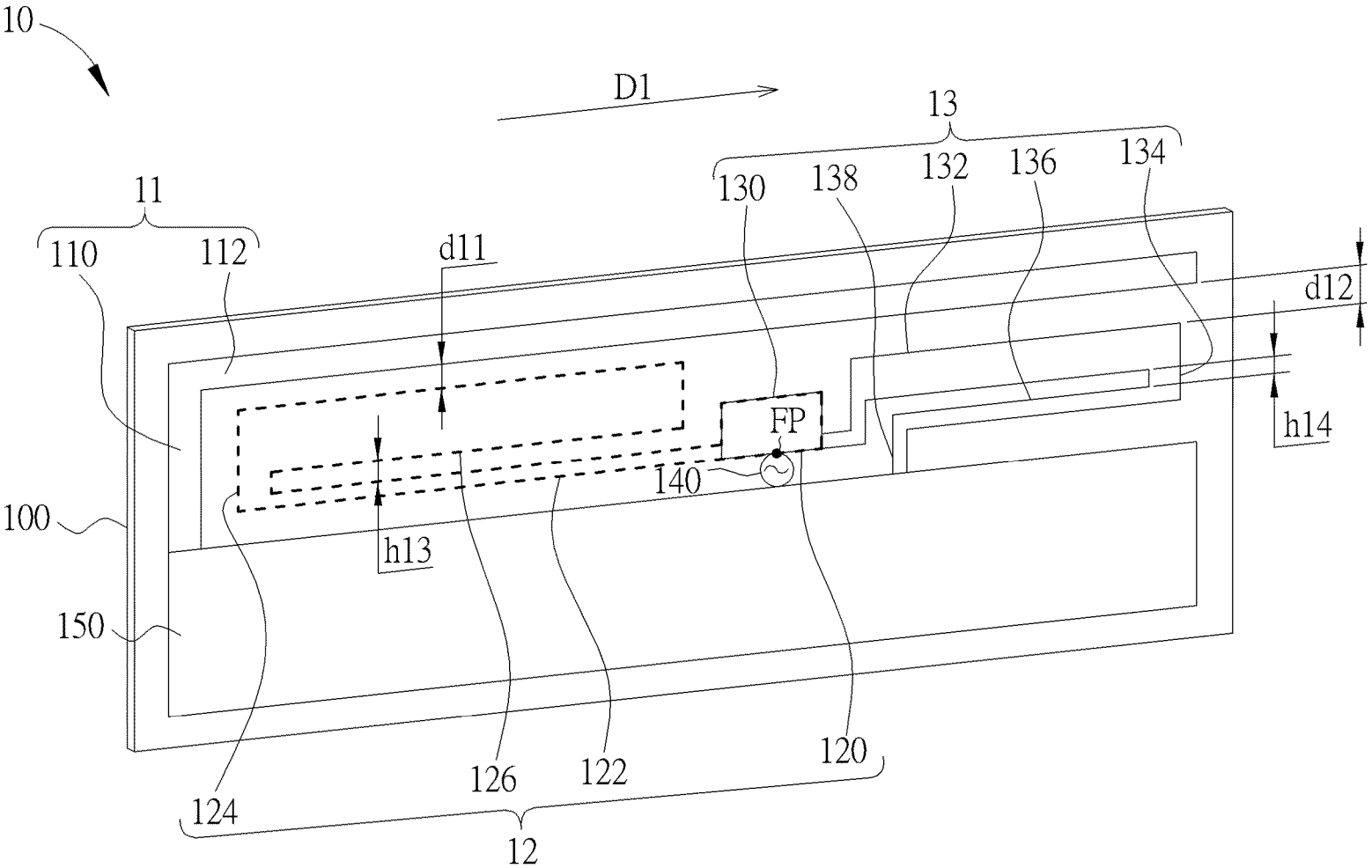
FIG. 1A is a three-dimensional view of a broadband antenna according to an embodiment of the present invention.
Figure 1B:
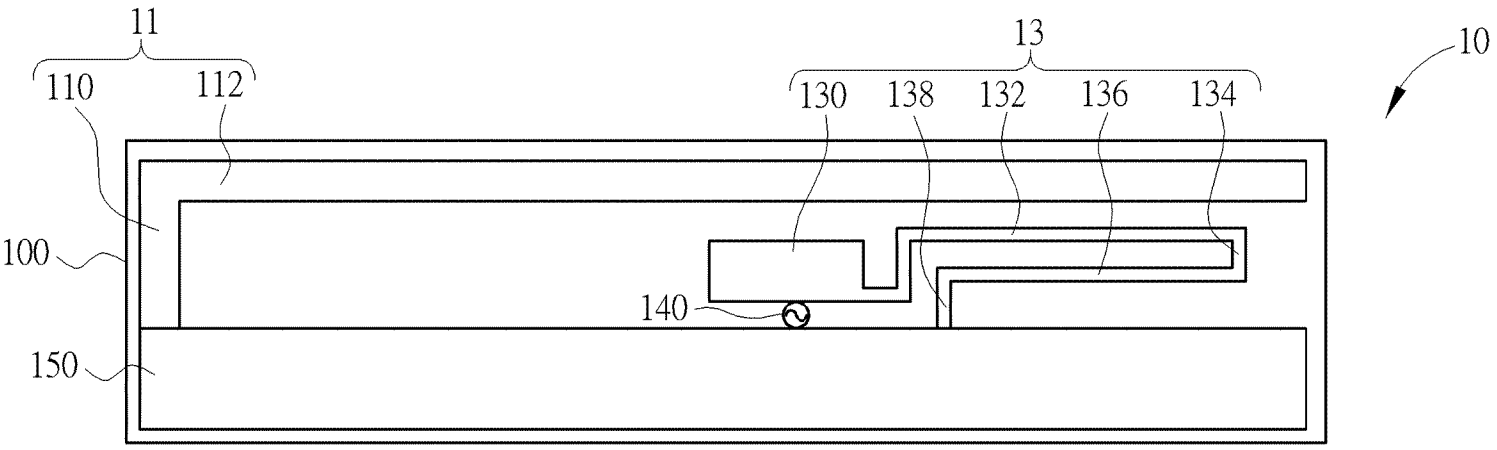
FIG. 1B shows a two-dimensional view of the broadband antenna shown in FIG. 1A seeing from the top plane.
Figure 1C:
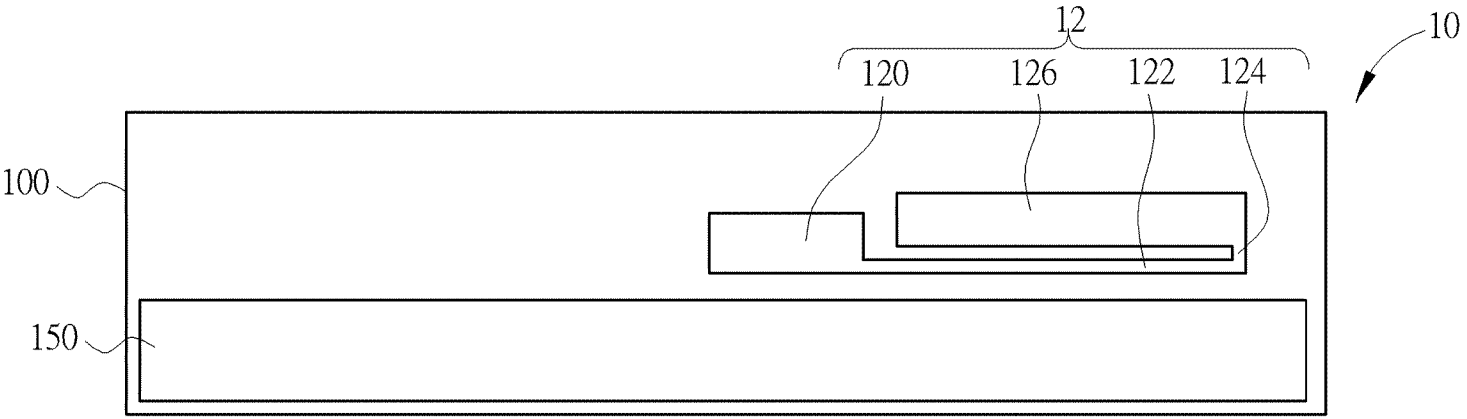
FIG. 1C shows a two-dimensional view of the broadband antenna shown in FIG. 1A seeing from the bottom plane.
Figure 1D:
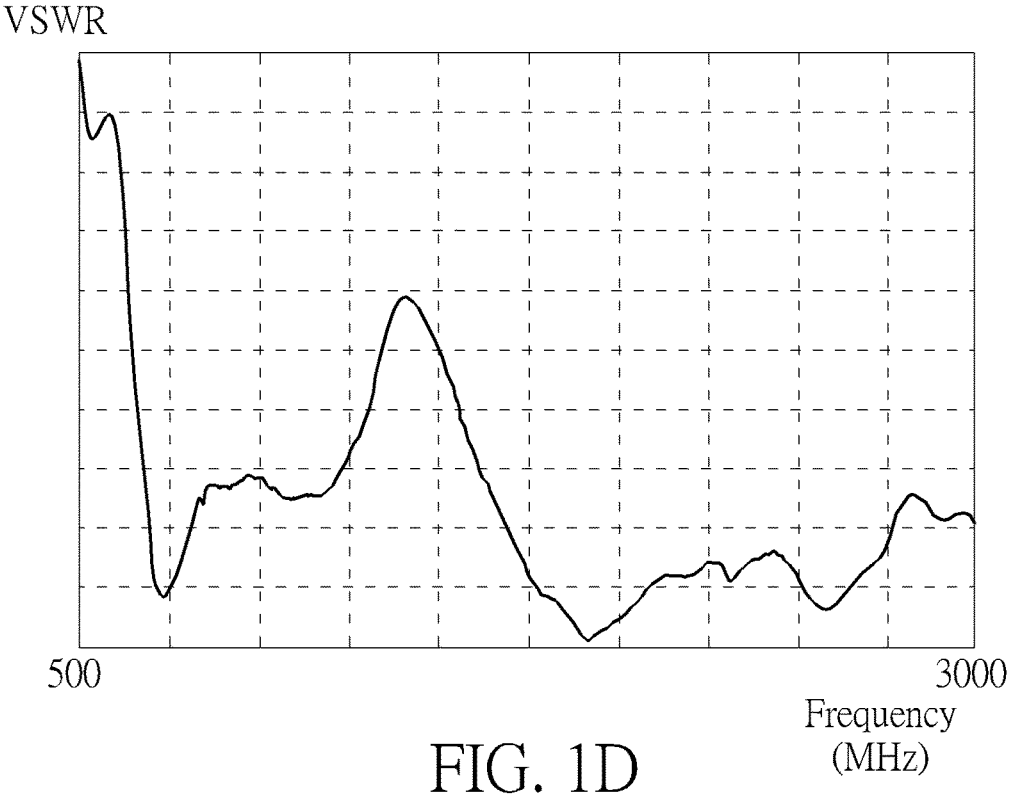
FIG. 1D shows a voltage standing wave ratio (VSWR) diagram of the broadband antenna shown in FIG. 1A.
Figure 1E:
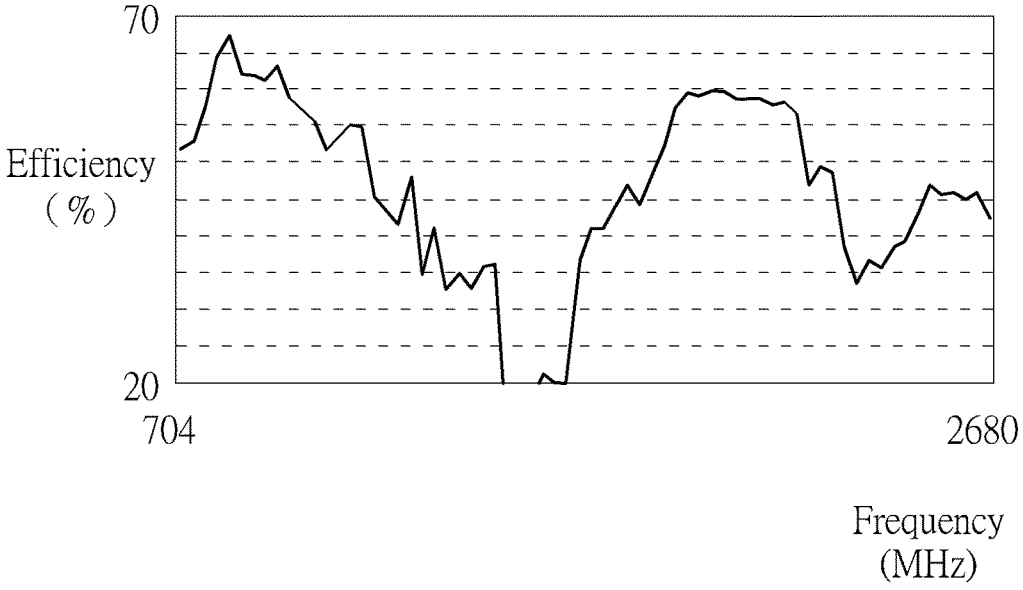
FIG. 1E shows a radiation efficiency diagram of the broadband antenna shown in FIG. 1A.

Please refer to FIGS. 1A-1E. FIG. 1A is a three-dimensional view of a broadband antenna 10 according to an embodiment of the present invention, FIG. 1B shows a two-dimensional view of the broadband antenna 10 seeing from its top plane. FIG. 1C shows a two-dimensional view of the broadband antenna 10 seeing from its bottom plane. FIG. 1D shows a voltage standing wave ratio (VSWR) diagram of the broadband antenna 10, and FIG. 1E shows a radiation efficiency diagram of the broadband antenna 10. The broadband antenna 10 may be used in a wireless communication device for transmitting or receiving signals on a wide band or multiple bands at different frequencies, such as signals for LTE wireless communication system (which approximately operates from 704 MHz to 960 MHz and from 1710 MHz to 2700 MHz). The broadband antenna 10 includes a substrate 100, a first radiating element 11, a second radiating element 12, a third radiating element 13, a signal feed-in element 140, and a grounding unit 150. The grounding unit 150 may be connected with the system grounding part of the wireless communication device for providing ground. The first radiating element 11 includes a first segment 110 and a second segment 112. The first segment 110 and the second segment 112 are connected and substantially perpendicular to each other. The first segment 110 is electrically connected to the grounding unit 150, which forms a grounded type coupling antenna unit. The second radiating element 12 forms a monopole antenna unit, and it is coupled to the first radiating element 11. The third radiating element 13 forms a loop antenna unit, in which one end is coupled to the second radiating element 12 and the other end is electrically connected to the grounding unit 150. The third radiating element 13 has a feed-in point FP. The signal feed-in element 140 is electrically connected to the feed-in point FP for emitting or receiving radio signals of the wireless communication device via the third radiating element 13, the second radiating element 12, and the first radiating element 11.

Noticeably, the first radiating element 11, the second radiating element 12, and the third radiating element 13 are disposed on the substrate 100 along a direction defined by an order of the first segment 110 of the first radiating element 11, the second radiating element 12, and the third radiating element 13 (e.g. the direction D1 shown in FIG. 1A), and the second segment 112 of the first radiating element 11 extends to the same direction (i.e., the direction D1). In other words, given that the signal feed-in element 140 is located at the center, the low frequency grounded type coupling antenna unit and the high frequency monopole antenna unit made by the first radiating element 11 and the second radiating element 12, respectively, are roughly located at the left hand side, and the high frequency loop antenna unit made by the third radiating element 13 is roughly located at the right hand side. In another example, the antenna units may be mirrored, and the first radiating element 11, the second radiating element 12, and the third radiating element 13 are also disposed on the substrate along a certain direction defined by the order of the first segment 110 of the first radiating element 11, the second radiating element 12, and the third radiating element 13. Such arrangement can improve the bandwidth and performance of the broadband antenna 10 while the broadband antenna 10 is able to conform to the regulations of SAR.

The substrate 100 may be a double-sided printed circuit board (PCB), where the first radiating element 11 and the third radiating element 13 are formed on a first surface (e.g. the top plane) of the substrate 100 and the second radiating element 12 is formed on a second surface (e.g. the bottom plane) of the substrate 100. The first surface and the second surface are parallel but opposite to each other. The second radiating element 12 may include a third segment 122, a first bending part 124, and a fourth segment 126. The first bending part 124 and the first segment 110 of the first radiating element 11 are substantially parallel and coupled with each other. The fourth segment 126 and the second segment 112 of the first radiating element 11 are substantially parallel and coupled with each other. The third segment 122 of the second radiating element 12 and the fourth segment 126 are also coupled with each other. The third radiating element 13 may include a fifth segment 132, a second bending part 134, a sixth segment 136, and a grounding part 138. The fifth segment 132 and the second segment 112 of the first radiating element 11 are substantially parallel and coupled with each other. The sixth segment 136 and the fifth segment 132 are also coupled with each other. The grounding part 138 is electrically connected to the grounding unit 150.

The second radiating element 12 and the third radiating element 13 of the broadband antenna 10 propagate radio signals by coupling effect. More specifically, the third radiating element 13 includes a feed-in area 130 with a feed-in point FP, the second radiating element 12 includes a feed-in coupling area 120, and the feed-in area 130 of the third radiating element 13 substantially overlaps a projected area defined by projecting the feed-in coupling area 120 of the second radiating element 12 onto the first surface of the substrate 100 such that radio signals transmitted from the signal feed-in element 140 can be coupled to the second radiating element 12 via the feed-in point FP and the feed-in area 130 of the third radiating element 13.

Furthermore, in the broadband antenna 10, electromagnetic energy is coupled from the feed-in point FP of the loop antenna unit to the monopole antenna unit which is disposed on the opposite surface of the substrate 100. The energy then flows between the monopole antenna unit and the grounded type coupling antenna unit by coupling effect. As a result, the lower resonant frequency band is further lowered while multiple resonant modes are induced at high frequency bands, which therefore leads to the broadband characteristic of the antenna. The first radiating element 11 provides a signal path for low frequency modes at, for example, 704 MHz-960 MHz, and it is approximately equal to a quarter-wavelength long. The third radiating element 13 provides a signal path for high frequency modes at, for example, 1710 MHz-2300 MHz, and it is approximately equal to half wavelength long. The second radiating element 12 receives electromagnetic energy which is coupled from the feed-in area 130 to the feed-in coupling area 120 and therefore induces additional high frequency modes at, for example, 2300 MHz-2700 MHz. The length of the second radiating element 12 is approximately equal to a quarter-wavelength. As shown in FIG. 1D and FIG. 1E, the matching of the broadband antenna 10 is good in multiple operational frequency bands, and the antenna maintains preferable radiation efficiency within the operational frequency bands (e.g. 704 MHz-960 MHz and 1710 MHz-2700 MHz).

The present invention employs a monopole antenna unit combining a grounded type coupling antenna unit and a loop antenna unit to improve the operational bandwidth of the antenna, reduce the antenna dimensions, and further conform to the regulation of SAR. The broadband antenna 10 shown in FIG. 1A and the related figures are examples of the present invention. Those skilled in the art may make modifications and/or alterations accordingly. For example, the third radiating element and the second radiating element may be electrically connected by the coupling effect at the feed-in area or the feed-in element, or by directly connecting the ends of the two radiating elements. In addition, the feed-in area 130 of the third radiating element 13 and the feed-in coupling area 120 of the second radiating element 12 may be substantially rectangle as the example shown in FIG. 1A. However, the shapes of the feed-in area 130 and the feed-in coupling area 120 are not limited herein. Other shapes such as triangle and polygon may be used as well.

Since the operational frequency, bandwidth, efficiency of an antenna are related to the shape and material that form the antenna, designers may make appropriate modification on the width, length, turning direction, distance between two coupled radiating elements, or the size of open slots for the broadband antenna 10 according to system requirement. For example, the coupling distance d11 between the second segment 112 of the first radiating element 11 and the fourth segment 126 of the second radiating element 12, the coupling distance d12 between the second segment 112 of the first radiating element 11 and the fifth segment 132 of the third radiating element 12, the slot h13 between the third segment 112 and the fourth segment 126 of the second radiating element 12, and/or the slot h14 between the fifth segment 132 and the sixth segment 136 of the third radiating element 13 may be modified appropriately to adjust the impedance matching and change the resonant frequency of the antenna so as to comply with the antenna performance requirements of different wireless communication protocols.

Figure 2A:
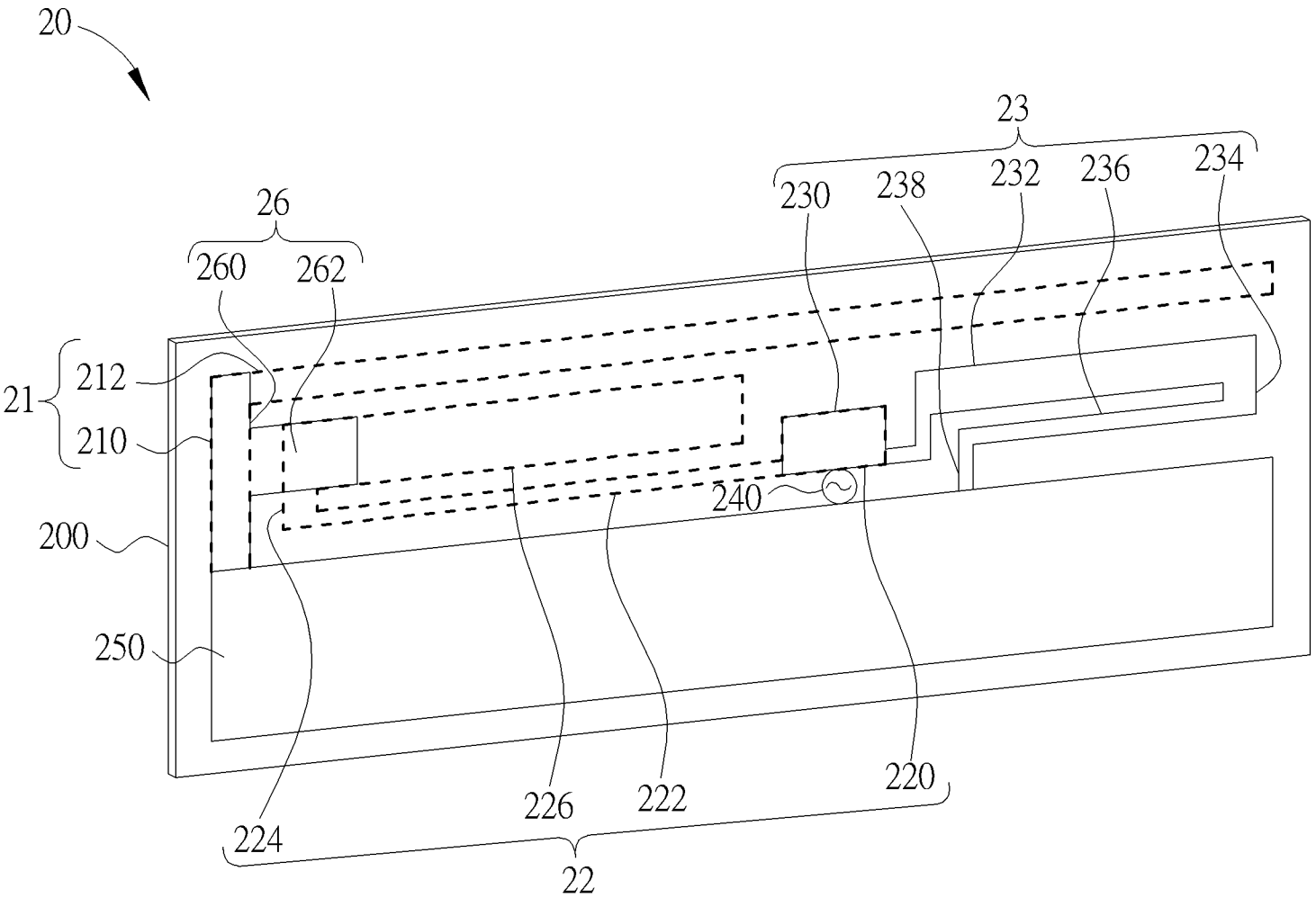
FIG. 2A is a three-dimensional view of a broadband antenna according to an embodiment of the present invention.
Figure 2B:
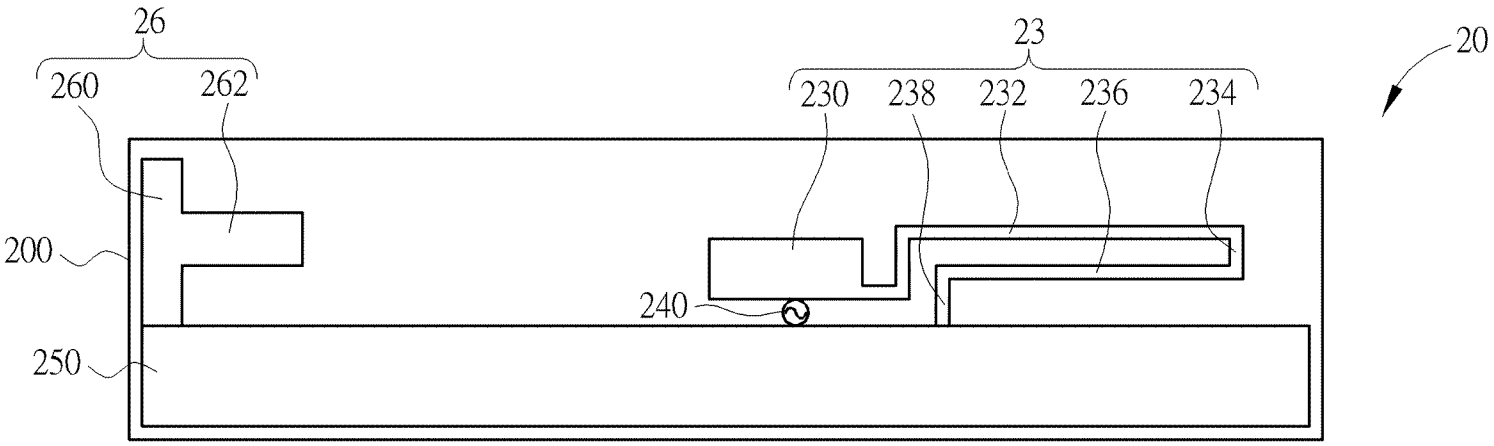
FIG. 2B shows a two-dimensional view of the broadband antenna shown in FIG. 2A seeing from the top plane.
Figure 2C:
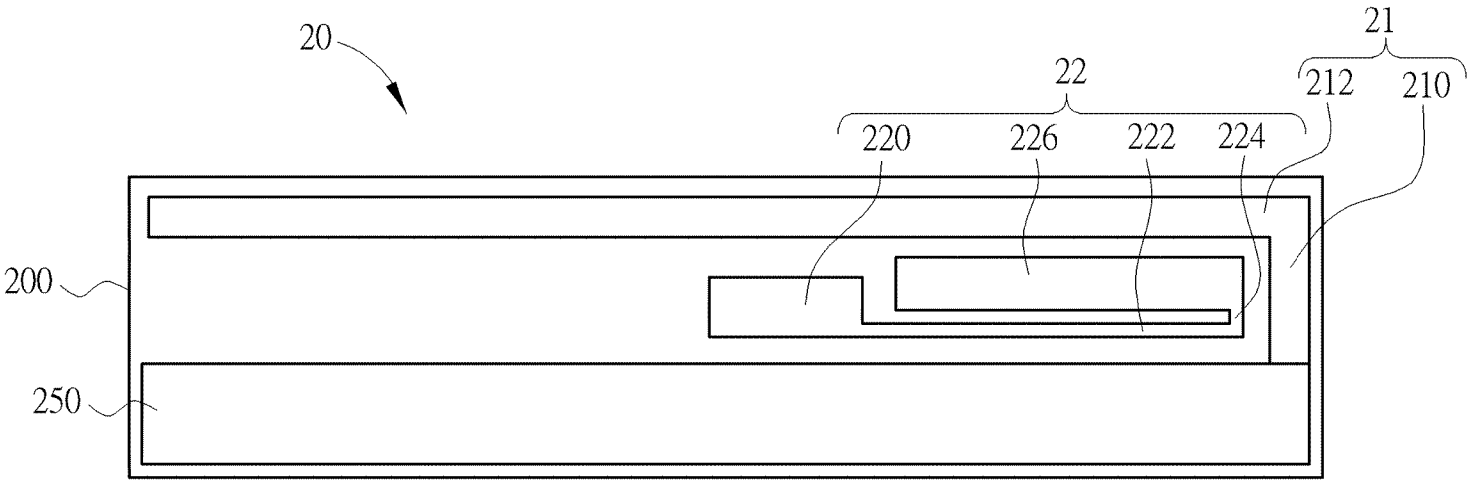
FIG. 2C shows a two-dimensional view of the broadband antenna shown in FIG. 2A seeing from the bottom plane.
Figure 2D:
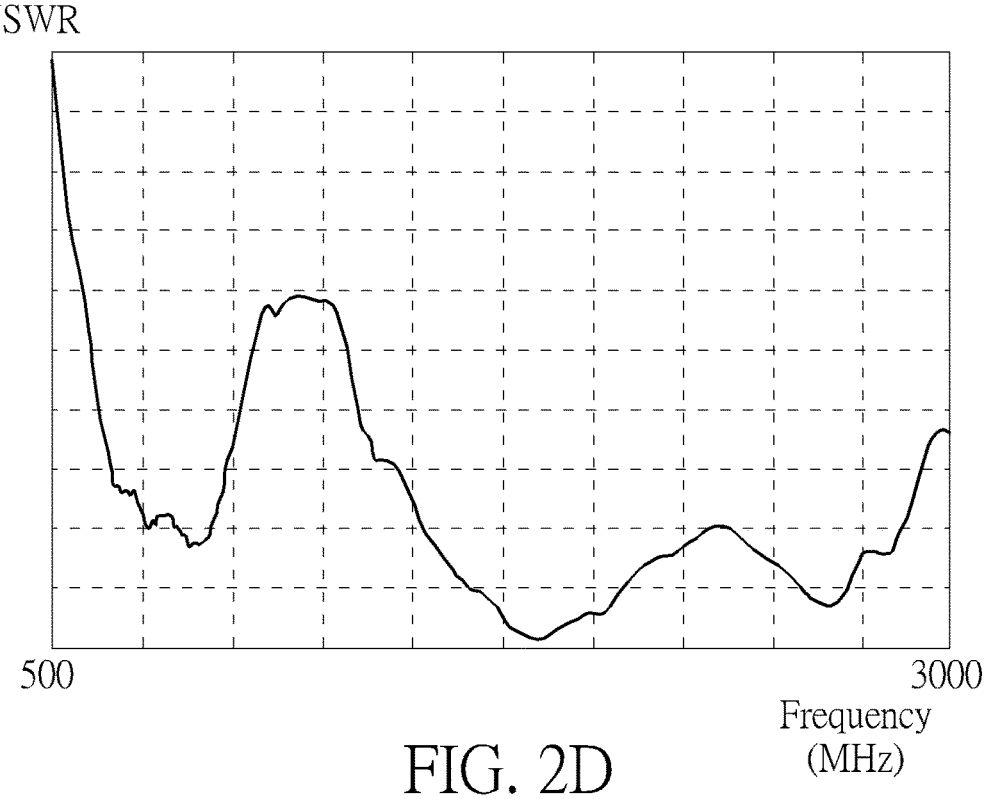
FIG. 2D shows a VSWR diagram of the broadband antenna shown in FIG. 2A.
Figure 2E:
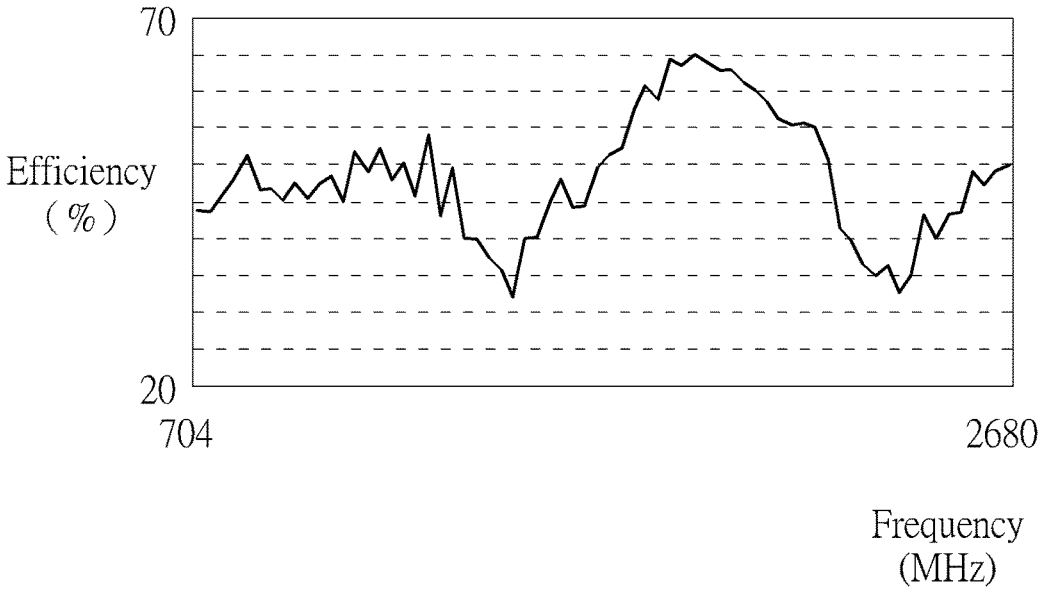
FIG. 2E shows a radiation efficiency diagram of the broadband antenna shown in FIG. 2A.

Referring to FIGS. 2A-2E, where FIG. 2A is a three-dimensional view of a broadband antenna 20 according to an embodiment of the present invention, FIG. 2B shows a two-dimensional view of the broadband antenna 20 seeing from the top plane, FIG. 2C shows a two-dimensional view of the broadband antenna 20 seeing from the bottom plane, FIG. 2D shows a VSWR diagram of the broadband antenna 20, and FIG. 2E shows a radiation efficiency diagram of the broadband antenna 20, the broadband antenna 20 is similar to the broadband antenna 10. However, the first radiating element 21 and the second radiating element 22 of the broadband antenna 20 are formed on the second surface of the substrate 200, while the third radiating element 23 is formed on the first surface of the substrate 200. Moreover, a grounded coupling element 26 is also formed on the first surface of the substrate 200. It is electrically connected to the grounding unit 250 and is coupled to the first radiating element 21 and the second radiating element 22 formed on the second surface of the substrate 200.

The grounded coupling element 26 may include a coupling part 260 and a coupling branch 262. A projected area defined by projecting the coupling part 260 onto the second surface of the substrate 200 may substantially overlap the first segment 210 of the first radiating element 21. A projected area defined by projecting the coupling branch 262 onto the second surface of the substrate 200 may partially overlap the fourth segment 226 of the second radiating element 22. Owing to the coupling effect between the grounded coupling element 26 and the first/second radiating elements 21/22, the operational bandwidth of the low frequency band is further increased without additional area cost. Compared to the previous example, the length of the radiating element of the broadband antenna 20 can even be reduced under the same bandwidth requirement, and therefore the antenna dimension is minimized.

In this embodiment, the first radiating element 21 provides a signal path for low frequency modes at, for example, 704 MHz-960 MHz, and it is approximately equal to a quarter-wavelength long. The grounded coupling element 26 and the second radiating element 22 are coupled with each other, inducing resonant modes at, for example, 824 MHz-960 MHz such that the operational frequency bandwidth at the low frequency bands is increased and the antenna matching is improved. The third radiating element 23 provides a signal path for high frequency modes at, for example, 1710 MHz-2300 MHz, and it is approximately equal to half wavelength long. The second radiating element 22 receives electromagnetic energy which is coupled from the feed-in area 230 to the feed-in coupling area 220 and therefore induces additional high frequency modes at, for example, 2300 MHz-2700 MHz. The length of the second radiating element 22 is approximately equal to a quarter-wavelength. As shown in FIG. 2D and FIG. 2E, including the grounded coupling element 26 in the broadband antenna 20 helps to direct some of the low frequency electromagnetic energy to the second radiating element 22 formed on the second surface of the substrate 200, and therefore increases the operational bandwidth at low frequency while providing preferable antenna matching at high frequency bands.

Figure 3A:
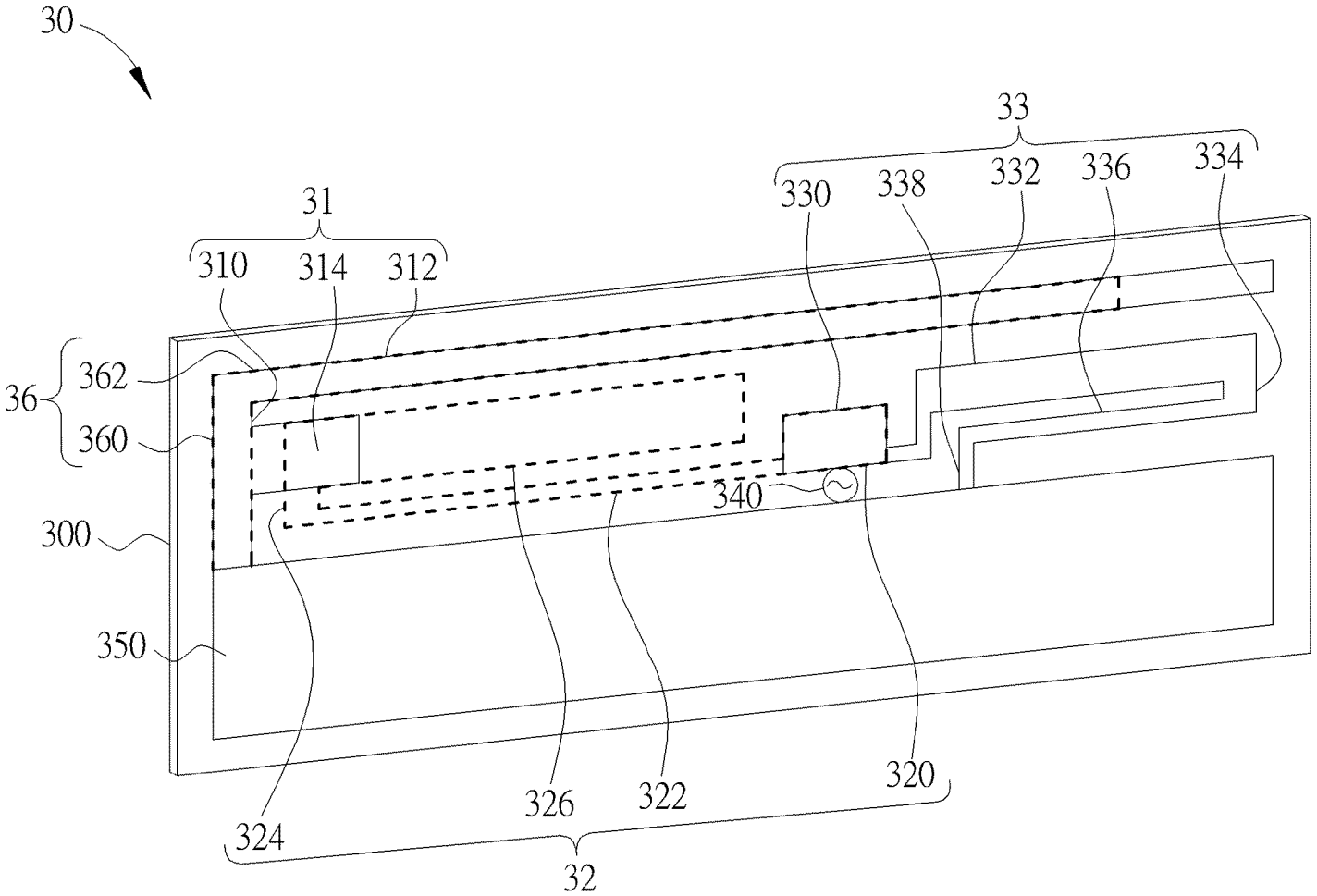
FIG. 3A is a three-dimensional view of a broadband antenna according to an embodiment of the present invention.
Figure 3B:
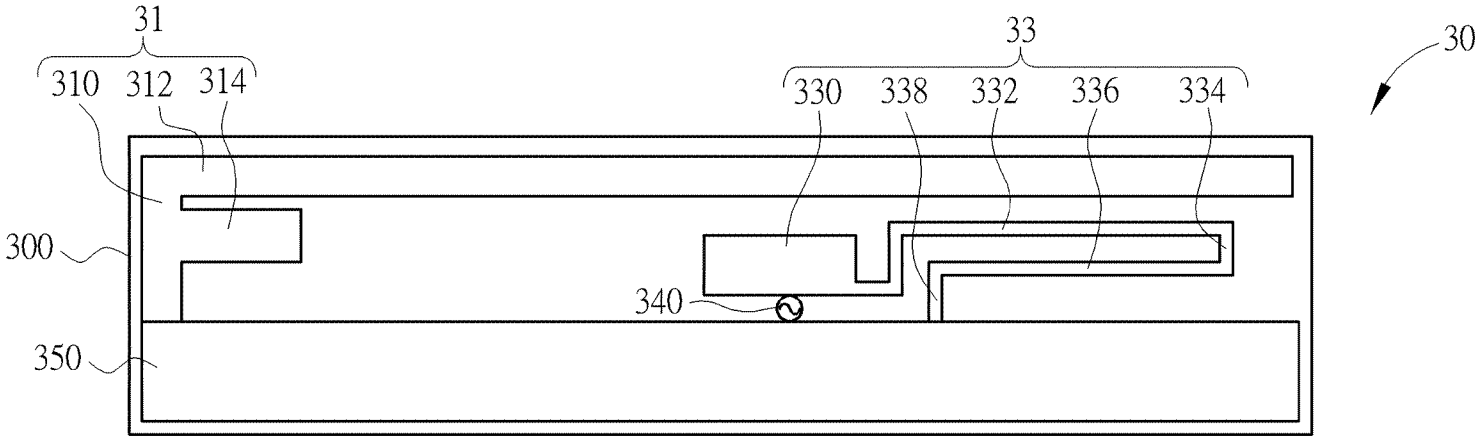
FIG. 3B shows a two-dimensional view of the broadband antenna shown in FIG. 3A seeing from the top plane.
Figure 3C:
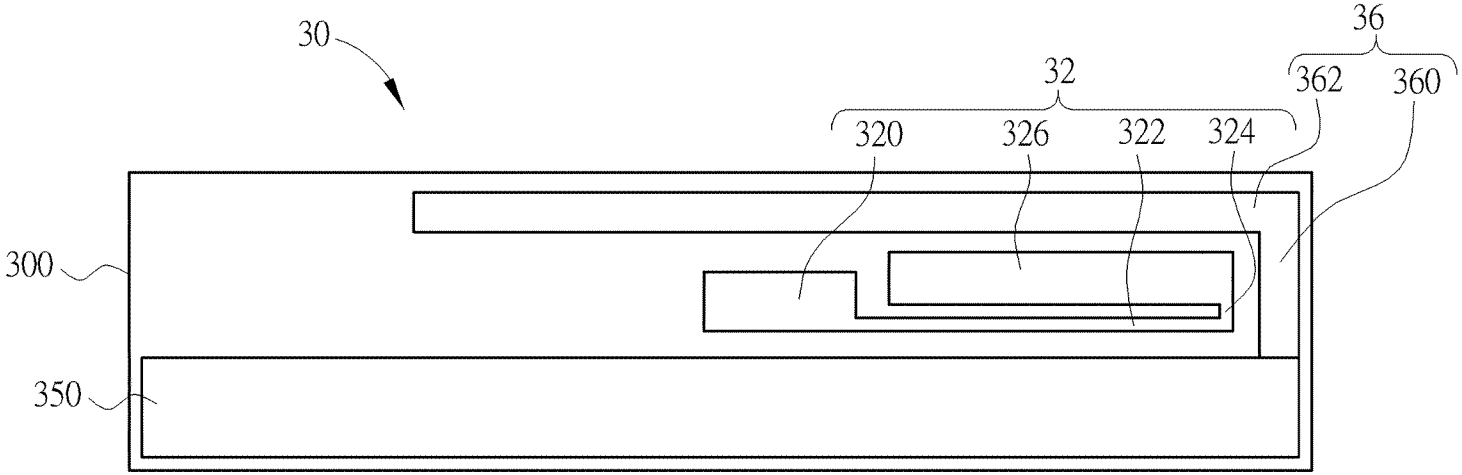
FIG. 3C shows a two-dimensional view of the broadband antenna shown in FIG. 3A seeing from the bottom plane.
Figure 3D:
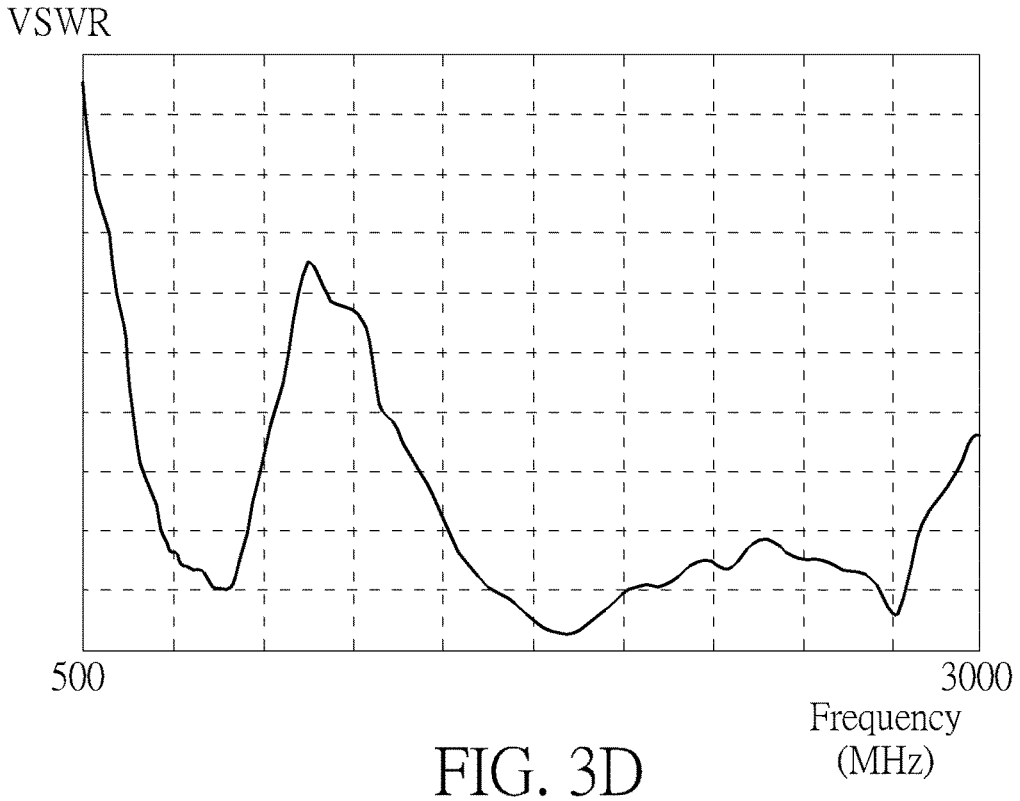
FIG. 3D shows a VSWR diagram of the broadband antenna shown in FIG. 3A.
Figure 3E:
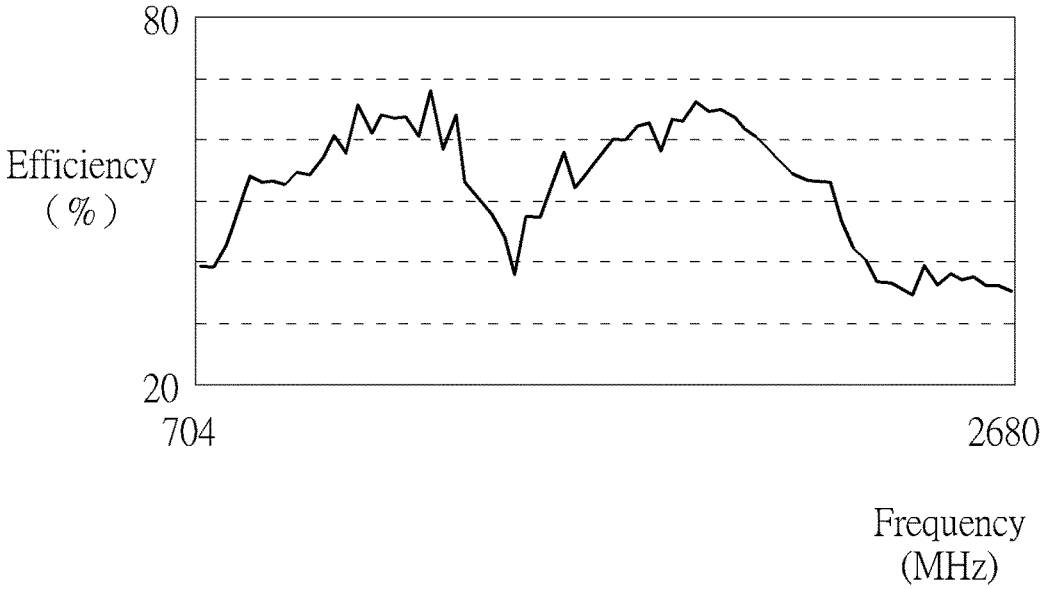
FIG. 3E shows a radiation efficiency diagram of the broadband antenna shown in FIG. 3A.

Referring to FIGS. 3A-3E, where FIG. 3A is a three-dimensional view of a broadband antenna 30 according to an embodiment of the present invention, FIG. 3B shows a two-dimensional view of the broadband antenna 30 seeing from the top plane, FIG. 3C shows a two-dimensional view of the broadband antenna 30 seeing from the bottom plane, FIG. 3D shows a VSWR diagram of the broadband antenna 30, and FIG. 3E shows a radiation efficiency diagram of the broadband antenna 30, the broadband antenna 30 is similar to the broadband antenna 10. However, the broadband antenna 30 further includes a grounded coupling element 36 formed on the second surface of the substrate 300. The grounded coupling element 36 is electrically connected to the grounding unit 350, and is coupled to the first radiating element 31. In addition to the first segment 310 and the second segment 312, the first radiating element 31 further includes a coupling branch 314 in order to enhance the coupling effect between the first radiating element 31 and the second radiating element 32.

The first radiating element 31 and the third radiating element 33 are formed on the first surface of the substrate 300, and the second radiating element 32 and the grounded coupling element 36 are formed on the second surface of the substrate 300. The grounded coupling element 36 includes coupling parts 360 and 362, which overlap a projected area defined by projecting the first segment 310 and the second segment 312 of the first radiating element 31 onto the second surface of the substrate 300, respectively. Moreover, the coupling branch 314 partially overlaps a projected area defined by projecting the fourth segment 326 of the second radiating element 32 onto the first surface of the substrate 300. As a result, the electromagnetic energy coupled between the low frequency radiating element and the high radiating element is increased because of adding the grounded coupling element 36 and the coupling branch 314 of the first radiating element 31. Thus, the antenna matching at both of the high frequency bands and the low frequency bands is improved.

In this embodiment, the first radiating element 31 provides a signal path for low frequency modes at, for example, 704 MHz-960 MHz, and it is approximately equal to a quarter-wavelength long. The coupling branch 314 of the first radiating element 31 and the second radiating element 32 are coupled with each other, inducing resonant modes at, for example, 824 MHz-960 MHz such that the operational frequency bandwidth at the low frequency bands is increased and the antenna matching is improved. The third radiating element 33 provides a signal path for high frequency modes at, for example, 1710 MHz-2300 MHz, and it is approximately equal to half wavelength long. The second radiating element 32 receives electromagnetic energy which is coupled from the feed-in area 330 to the feed-in coupling area 320 and therefore induces additional high frequency modes at, for example, 2300 MHz-2700 MHz. The length of the second radiating element 32 is approximately equal to a quarter-wavelength. As shown in FIG. 3D and FIG. 3E, the broadband antenna 30 may have wider operational frequency bandwidth which covers much higher frequency while having preferable radiation efficiency. Therefore, the broadband antenna 30 may be used in a wireless communication system with a system specification requiring very wide bandwidth.

Figure 4A:
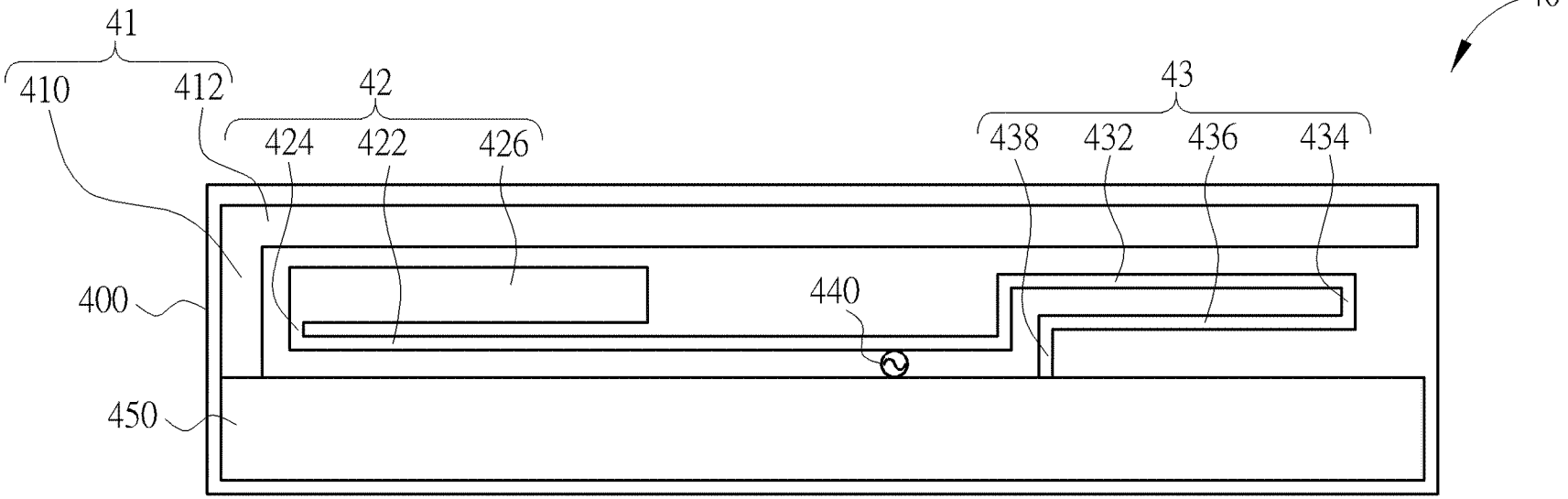
FIG. 4A is a schematic diagram of a broadband antenna according to an embodiment of the present invention.
Figure 4B:
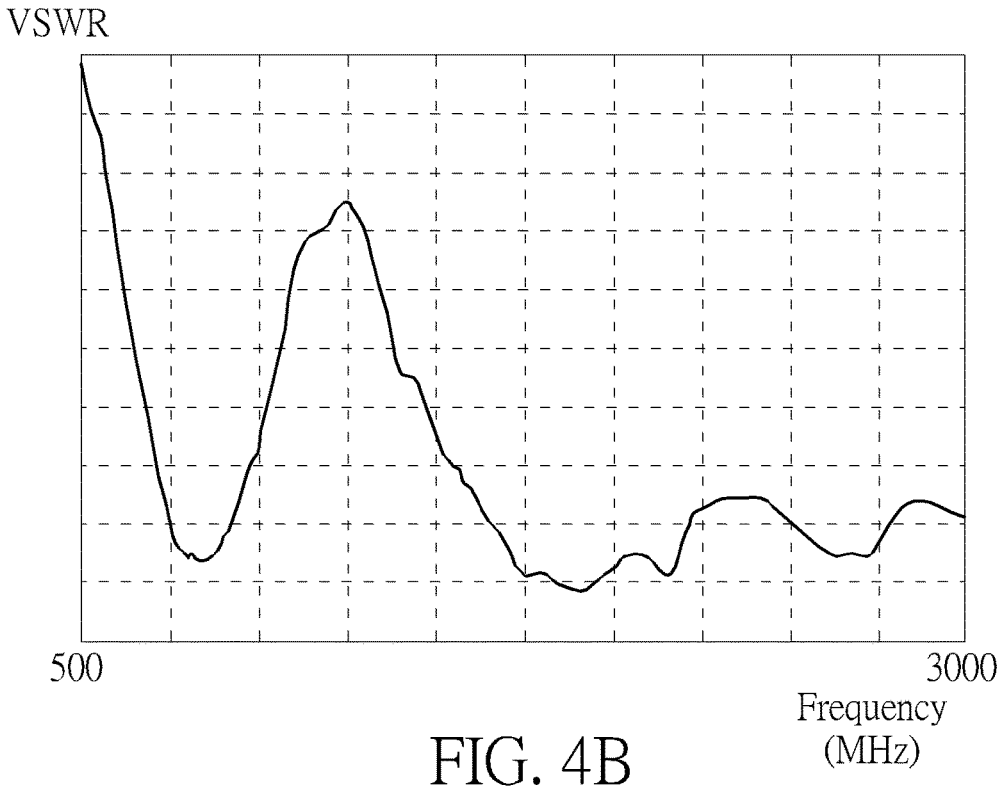
FIG. 4B shows a VSWR diagram of the broadband antenna shown in FIG. 4A.
Figure 4C:
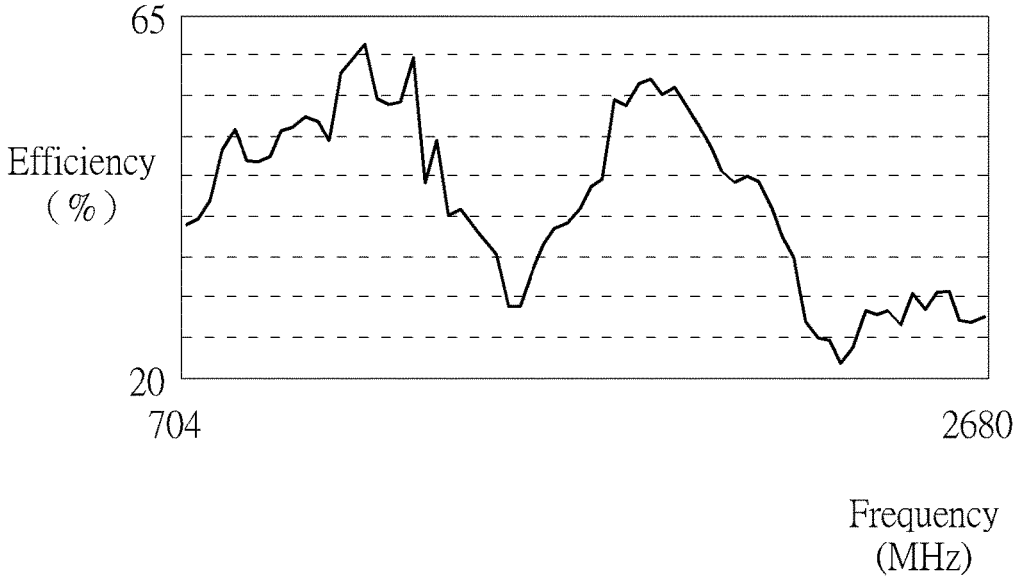
FIG. 4C shows a radiation efficiency diagram of the broadband antenna shown in FIG. 4A.

Referring to FIGS. 4A-4C, where FIG. 4A is a schematic diagram of a broadband antenna 40 according to an embodiment of the present invention, FIG. 4B shows a VSWR diagram of the broadband antenna 40, and FIG. 4C shows a radiation efficiency diagram of the broadband antenna 40, the broadband antenna 40 is similar to the broadband antenna 10. However, all of the radiating elements or parts in the broadband antenna 40 are formed on the same surface of the substrate 400. Another difference between the broadband antenna 40 and the broadband antenna 10 is that in FIG. 4A the third radiating element 43 is directly connected to the second radiating element 42, whereas in FIG. 1A the third radiating element 13 is electrically connected to the second radiating element 12 by coupling effect.

Because the structure of the broadband antenna 40 enables the electromagnetic energy at the feed-in point to be directed to both the loop antenna unit (i.e. the third radiating element 43) and the monopole antenna unit (i.e. the second radiating element 42) at the same time and induces the coupling effect between the monopole antenna unit and the grounded type coupling antenna unit (i.e. the first radiating element 41), the resonant frequencies at the low frequency bands are lowered while multiple resonant modes are induced at the high frequency bands, which contributes to the broadband characteristics of the broadband antenna 40. The broadband antenna 40 may be implemented on a single plane, so its manufacturing cost is relatively low. Moreover, the resonant frequencies and the impedance matching of the antenna may be adjusted by changing the open slot size of the second radiating element 42 or the third radiating element 43, and/or by tuning the coupling distance between the first radiating element 41 and the second/third radiating elements 42/43 so that different antenna performance may be achieved to comply with the wireless communication system requirement. The third radiating element 43 is grounded. Therefore, the current distribution of the broadband antenna 40 may be more uniformly distributed, which is beneficial for optimizing the antenna performance while conforming to the regulations of SAR.

In this embodiment, the first radiating element 41 provides a signal path for low frequency modes at, for example, 704 MHz-960 MHz, and it is approximately equal to a quarter-wavelength long. The third radiating element 43 provides a signal path for high frequency modes at, for example, 1710 MHz-2300 MHz, and it is approximately equal to half wavelength long. The second radiating element 42 provides additional signal path for high frequency modes at, for example, 2300 MHz-2700 MHz, and it is approximately equal to a quarter-wavelength long. As shown in FIG. 4B and FIG. 4C, the broadband antenna 40 also has wide operational frequency bandwidth and preferable radiation efficiency. In addition, the size of the broadband antenna 40 is small, and the antenna radiation also conforms to the regulations of SAR. Thus, this embodiment can also overcome the conventional antenna design problem—that is, the conventional antenna designs are difficult to meet both requirements for SAR and wide operational bandwidth at the same time.

Furthermore, the antenna radiation frequency, bandwidth and efficiency are closely correlated with the antenna shape and the materials used in the antenna. Therefore, designers may appropriately modify the dimensions of the radiating elements, the bending directions, the coupling distances, the open slot sizes, etc. of the broadband antennas 10, 20, 30 and 40 to comply with requirements of the wireless communication systems. Any alterations and/or modifications such as varying the material, manufacturing methods, shape, and position of the components should be within the scope of the present invention as long as the abovementioned concept of the present invention is met.

In conclusion, the present invention utilizes a monopole antenna unit combining a grounded type coupling antenna unit and a loop antenna unit to increase the operational bandwidth, improve radiation efficiency, and reduce the dimension of the antenna while the antenna conforms to the regulations of SAR under all of the operational frequency bands. Moreover, the structure of the broadband antenna in the present invention forms multiple coupling spacing and open slots within or between the radiating elements. These coupling spacing and open slots provide enough design flexibilities for adjusting the impedance matching, the bandwidth, and the shifting of resonant frequencies so that the antenna of the present invention is applicable to many kinds of wireless communication systems with different operational frequency bands.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A broadband antenna used in a wireless communication device, comprising:

a substrate;

a grounding unit, for providing ground;

a first radiating element, comprising a first segment and a second segment, substantially perpendicular to each other, wherein the first segment is electrically connected to the grounding unit and the second segment extends toward a direction;

a second radiating element, coupled to the first radiating element;

a third radiating element, having a terminal coupled to or electrically connected to the second radiating element and another terminal electrically connected to the grounding unit; and a signal feed-in element, electrically connected with the third radiating element for transmitting or receiving a radio signal;

wherein the first, the second, and the third radiating elements are disposed on the substrate along the direction defined by an order of the first segment of the first radiating element, the second radiating element and the third radiating element;

wherein the third radiating element and the second segment of the first radiating element are coupled with each other;

wherein the third radiating element is formed on a first surface of the substrate, the second radiating element is formed on a second surface of the substrate parallel to the first surface, and the first radiating element is formed on the first surface or the second surface of the substrate;

wherein the third radiating element further comprises a feed-in area, the signal feed-in element connects to a feed-in point in the feed-in area, the second radiating element further comprises a feed-in coupling area, and the feed-in area of the third radiating element substantially overlaps a projected area defined by projecting the feed-in coupling area of the second radiating element onto the first surface of the substrate.

2. The broadband antenna of claim 1, wherein the second radiating element comprises a third segment, a first bending part, and a fourth segment, the first bending part and the first segment of the first radiating element are substantially parallel and coupled with each other, and the fourth segment and the second segment of the first radiating element are substantially parallel and coupled with each other.

3. The broadband antenna of claim 2, wherein the third segment and the fourth segment of the second radiating element are coupled with each other.

4. The broadband antenna of claim 1, wherein the third radiating element comprises a fifth segment, a second bending part, a sixth segment, and a grounding part, the fifth segment and the second segment of the first radiating element are substantially parallel and coupled with each other, the sixth segment and the fifth segment are coupled with each other, and the grounding part is connected to the grounding unit.

5. The broadband antenna of claim 1, wherein the feed-in area and the feed-in coupling area are rectangular.

6. The broadband antenna of claim 1, further comprising a grounded coupling element, connected with the grounding unit and coupled with the first radiating element or the second radiating element.

7. The broadband antenna of claim 6, wherein the grounded coupling element is formed on another surface of the substrate opposite to the surface where the first radiating element is formed, and the grounded coupling element overlaps a projected area defined by projecting the first radiating element onto the another surface.

8. The broadband antenna of claim 7, wherein the grounded coupling element comprises a coupling branch, the first radiating element and the second radiating element are formed on the second surface of the substrate, the third radiating element and the grounded coupling element are formed on the first surface of the substrate, and the coupling branch partially overlaps a projected area defined by projecting the fourth segment of the second radiating element onto the first surface of the substrate.

9. The broadband antenna of claim 7, wherein the first radiating element comprises a coupling branch, the first radiating element and the third radiating element are formed on the first surface of the substrate, the second radiating element and the grounded coupling element are formed on the second surface of the substrate, and the coupling branch partially overlaps a projected area defined by projecting the fourth segment of the second radiating element onto the first surface.

10. The broadband antenna of claim 1, wherein the first radiating element makes a grounded type coupling antenna unit, the second radiating element makes a monopole antenna unit, and the third radiating element makes a loop antenna unit.

* * * * *